US008813760B2

(12) United States Patent
May, Jr.

(10) Patent No.: US 8,813,760 B2
(45) Date of Patent: Aug. 26, 2014

(54) COMPOSITION FOR TOBACCO SUBSTITUTE

(76) Inventor: Lawrence Chester May, Jr., Milton, GA (US)

( * ) Notice: Subject to any disclaimer, the term of this patent is extended or adjusted under 35 U.S.C. 154(b) by 0 days.

(21) Appl. No.: 13/286,833

(22) Filed: Nov. 1, 2011

(65) Prior Publication Data

US 2012/0042888 A1 Feb. 23, 2012

Related U.S. Application Data

(63) Continuation of application No. 11/757,859, filed on Jun. 4, 2007, now Pat. No. 8,047,209.

(60) Provisional application No. 60/811,831, filed on Jun. 8, 2006.

(51) Int. Cl.

| | |
|---|---|
| ***A24B 15/16*** | (2006.01) |
| ***A24D 1/18*** | (2006.01) |
| *A24B 9/00* | (2006.01) |

(52) U.S. Cl.
CPC . *A24B 15/16* (2013.01); *A24D 1/18* (2013.01); *A24B 9/00* (2013.01)
USPC ..... 131/359

(58) Field of Classification Search
CPC ..... A24D 1/18; A24B 15/16
See application file for complete search history.

(56) References Cited

PUBLICATIONS

English Translation of KR1020010060268 Kim, Sep. 27, 2001.*

* cited by examiner

*Primary Examiner* — Michael J Felton
(74) *Attorney, Agent, or Firm* — Moazzam & Associates, LLC

(57) ABSTRACT

Compositions and methods for making same are presented that act as substitutes for tobacco and tobacco products. Use is made of a genus of plants called *pueraria*, and more specifically the kudzu species, which is processed and packaged to taste and feel similar to natural tobacco. Various enhancers and flavors are added to appeal to various tastes.

13 Claims, No Drawings

COMPOSITION FOR TOBACCO SUBSTITUTE

This application is a continuation of U.S. patent application Ser. No. 11/757,859, filed Jun. 4, 2007, now U.S. Pat. No. 8,047,209; which claims priority to U.S. Provisional Patent Application Ser. No. 60/811,831, filed Jun. 8, 2006, the content of which is hereby incorporated by reference herein in its entirety into this disclosure.

BACKGROUND OF THE INVENTION

1. Field of the Invention

The present invention relates to tobacco substitutes. In particular, the present invention relates to compounds and compositions for smokeless tobacco substitutes and methods of producing thereof.

2. Background of the Invention

The harmful effects of tobacco and tobacco products have been well documented in medical studies, well publicized legal battles and extensive public information campaigns. In particular, the toxicity of tobacco products is generally well known throughout the world. Despite the well known adverse health effects of tobacco and its products, many individuals still choose to partake in the use or consumption of tobacco in many forms. Many then become addicted to the heightened sensations that are provided by regular tobacco use. Due to the addictive nature of nicotine in tobacco products, cessation of use is extremely difficult and, even if possible for short periods of time, will cause negative physiological and psychological effects that tend to cause a relapse back to the use of the tobacco products.

One particular form of tobacco product is the smokeless tobacco, or tobacco that is not lit or smoked in the conventional way. In the case of moist smokeless tobacco, commonly referred to as snuff or dip, and chew or plug, the addiction contains a chemical dependency on the nicotine as well as physical cravings for the organoleptic qualities of the tobacco product. Snuff and dip are typically utilized by being held in a small wad against the mucous membranes. Chew and plug are typically utilized by being held in the mouth in the form of a large wad and is chewed or placed against the mucous membranes.

As a result of the deleterious effects of nicotine in tobacco, substitutes for tobacco, in the form of herbal compositions, produced and intended for personal use as moist snuff, have been developed and documented. A number of such substituted products have a fully non-tobacco based herbal composition. Many of such substitutes have an individual herb that is used as its primary ingredient. Primary ingredients are limited to, for example, red clover, corn silk, alfalfa, papaya leaves and tea leaves. Additional ingredients noted include dandelion, dock, sorrel, sunflower, *calendula, nasturtium*, mallow, clover, slippery elm bark and chicory.

Current commercial non-tobacco snuff products include a number of different primary ingredients, including but not limited to, tea leaves, red clover, coconut flakes, mint leaves, ginseng, apple, corn silk, grape leaf, basil leaf, and the like.

Other conventional tobacco substitute products stress the importance of the organoleptic qualities required of a snuff or chew to duplicate the mouth-feel of tobacco based qualities. Some conventional products refer exclusively to the commercially required "burn" feeling in the mouth associated with tobacco products and utilizes cayenne pepper to produce that feeling. Some conventional products stress the increased organoleptic qualities of corn silk as the primary reason for the use of this component as the primary ingredient.

Although the various primary ingredients in these tobacco substitute products have made some impact on the use of such less toxic compositions as a substitute for tobacco products, such alternatives still lack much of the feel of the natural tobacco product, thereby acting as only a safer, yet still distinguishable, "not as satisfying" alternative to the natural tobacco product. Thus, there is a need in the art for a more "natural" tasting and feeling product that more resembles natural tobacco, although not suffering from the same harmful drawbacks as natural tobacco. Such product should be easy to manufacture, ubiquitous, easy to cultivate and grow, safe and cost-effective.

SUMMARY OF THE INVENTION

The present invention provides a safer alternative to tobacco products by using a non-tobacco variety of plant called *pueraria* and variations of it. The products according to the present invention include the positive effects of the use of tobacco products, including taste and feel, without suffering from the negative effects thereof. The methods used to prepare and manufacture the *pueraria* plant to create the products are unique, easy to use and replicate, and cost effective.

Although various ingredients have been used as the primary ingredient in tobacco substitute products, none have yet disclosed or recognized the herbal plant *pueraria*, and in particular kudzu leaves as a feasible alternative to tobacco leaves or other mentioned herbal products. The use of this genus of plants, and in particular this species, results in a superior tobacco substitute product that provides a user with the advantages of a tobacco product including taste and organoleptic properties without suffering from the harmful effects from natural tobacco product use or the unsatisfying effects of conventional tobacco substitutes.

In one exemplary embodiment, the present invention is a composition for use as a tobacco substitute. The composition includes an herbal component including *pueraria*; a binder to create cohesion; and a humectant to maintain moisture content.

In another exemplary embodiment, the present invention is a composition for use as a tobacco substitute. The composition includes 45 to 80 percent by weight *pueraria* leaves as a base herb; 20 to 50 percent by weight glycerin as a binder and humectant; 0.00005 to 5 percent by weight flavoring as either essential oils or powder; and 0.00001 to 0.0002 percent by weight salt to provide flavor enhancement and act as an abrasive.

In yet another exemplary embodiment, the present invention is a method for producing a tobacco substitute. The method includes providing an herbal component including *pueraria*; adding a binder to create cohesion; and adding a humectant to maintain moisture content.

DETAILED DESCRIPTION OF THE INVENTION

The present invention provides a non-tobacco herbal compound that creates a moist cud in the mouth. Use of the compound can satisfy the physical cravings associated with moist snuff use without the toxicity associated with natural tobacco use.

In certain exemplary embodiments, the present invention provides for compounds, and methods of production, of natural tobacco substitutes. The compositions may be used in conventional snuff or chew, or other known or anticipated uses for tobacco and tobacco substitutes. Furthermore, products according to the present invention may be used in conjunction or mixed with natural tobacco products to dilute the harmful effects of the latter without significantly affecting the taste thereof. For example, a "light" natural product may be produced with natural tobacco and the products according to the present invention. In certain exemplary embodiments, use of a genus of plants known as *pueraria* is used as a primary herbal ingredient in the tobacco substitute product. In certain further exemplary embodiments, a particular species within the genus, popularly known as kudzu, can be used.

Although specific reference is made to the *pueraria* genus or kudzu species herein and throughout this disclosure, it is apparent to one having ordinary skill in the art that the present invention is not limited to this particular genus or species, but extends to all known and discoverable plants that share the same characteristics of the present genus and/or species and/or behave in the same fashion as described herein. Thus particular members of the genus or species, not specifically mentioned here, are also within the scope of the present invention. In particular, the following species of *pueraria* are within the scope of the present invention and may also be used in various embodiments of the present invention: *pueraria lobata* (*pueraria montana, pueraria thunbergiana*), *pueraria mirifica* (kwao krua or *butea superba*).

Furthermore, certain members of the tribe in which the genus of *pueraria* belongs to, namely the tribe phaseoleae, which is one of the subdivisions of the plant family, fabaceae, which includes the legumes, may also be within the purview and scope of the present invention. This tribe includes many of the beans cultivated for human and animal food. Some of the members within the tribe phaseoleae, and which can therefore also be included as a primary source ingredient within the present invention, include but are not limited to: moth bean (*Vigna acontifolia*); azuki bean (*Vigna angularis*); urad bean (*Vigna mungo*); mung bean (*Vigna radiata*); rice bean (*Vigna umbellate*); Bambara groundnut (*Vigna subterranea*, but placed by some authors in genus *Voandzeia*); cowpea (*Vigna unguiculata*), and subspecies catjang, black-eyed pea, and yardlong bean; winged bean (*Psophocarpus tetragonolobus*); common bean (*Phaseolus vulgaris*): includes varieties such as pinto and kidney beans; tepary bean (*Phaseolus acutifolius*); .runner bean (*Phaseolus coccineus*); lima bean (*Phaseolus lunatus*); hyacinth bean (*Lablab purpureus*); Kersting's bean (*Macrotyloma geocarpum*); pigeon pea (*Cajanus cajan*); soybean (*Glycine max*); and velvet bean (*Mucuna pruriens*).

As described above, *pueraria* is the genus for kudzu, and includes species such as lobata and montana. *Pueraria* is further part of the bean family. The specific species of *pueraria* listed here are primarily the same in terms of composition, taste and feel with a major difference being where they are grown. Most of the exemplary embodiments described herein are with reference to the lobata species (kudzu), although other species may also be used, as well as other members of the bean family. One having ordinary skill in the art would be cognizant of the other types and species of herbal ingredients that may be substituted for the specific types described herein in these examples. Such other types and species are also within the scope of the present invention.

The kudzu species of *pueraria* has been conventionally used as a flavoring. Although the part of the plant used in flavoring is not specified, the kudzu blossom is the only part of the plant that contains a strong flavor similar to grapes. The kudzu flavoring is generally created through use of plant material, blossoms, or through an extract generated exclusively from the blossoms. Its leaves have a distinguishing taste and feel, which are very similar to tobacco, make it an idea product to use as a tobacco substitute according to the present invention.

The root and leaves, which are also edible, do not have enough of a significant flavor to be used as a flavoring. The root is typically used as flour as it has a high content of starch. Kudzu leaves do not have a significant flavor albeit a very mild sweet taste. Thus, the leaves have not been generally used in flavoring and only young leaves are appropriate for use in salads or as a leaf vegetable due to the stiffness of the veins in larger leaves.

Through the study of the genus of *pueraria* and its edible species, including kudzu, the present invention set out to produce a superior substitute product for tobacco. Thus, a principle object of the present invention is to provide novel snuff and chew compositions that are nicotine-free and free of other toxic materials and still retain the characteristics of the commercially available tobacco products, such as taste, color, texture, aroma, flavor and "pack-ability", which is the ability to produce an effective "wad" for placement in the mouth.

The present invention provides for a compound or composition and method of manufacturing the same that can be used as a moist smokeless non-tobacco product being composed primarily of *pueraria* leaves and the process to create the compound. *Pueraria* have leaves that are firm and resilient which provide an excellent primary ingredient for a tobacco-free chewing compound or moist snuff compound. This compound creates a moist coherent cud that has superior organoleptic qualities resembling commercially available tobacco based products.

In a moist snuff, kudzu leaves when combined with an appropriate casing component and humectant will provide a light, airy texture that packs into a wad easily between the fingers for insertion in the user's mouth.

When used as a chew or plug, kudzu leaves combined with an appropriate casing component and humectant provide the necessary rigidity and cohesiveness to provide a wad that can be chewed in a manner similar to genuine chewing tobacco.

There are numerous advantages in using the compound or composition according to the present invention as the composition provides an alternative to tobacco based snuff without the nicotine, wherein the reduction in nicotine intake provides a large benefit to the user. The *pueraria* composition does not irritate the gums or mucous membrane of the user, thus providing additional benefit. In addition, the use of *pueraria* leaves provides better organoleptic qualities than other herbs in mimicking genuine tobacco products.

Many other advantages are also evident in including *pueraria*, and specifically kudzu, as a primary ingredient in the compositions according to the present invention. Kudzu is an extremely fast growing plant extending its vine up to 12 inches per day. Although its leaves are edible, it has not been widely used as a marketable crop. This makes it an inexpensive crop to use in production. Furthermore, kudzu based snuff "packs" like genuine tobacco, allowing the user to pinch a selected amount into a wad that is easily inserted into the mouth. Other primary herbal components such as red clover and/or corn silk require a heavy binder such as molasses in order to accomplish the same making it messy and/or stiff, not replicating the soft, airy texture of tobacco. The process to create the snuff or chew can produce large quantities of snuff in a manner of weeks rather than years as is required by the curing process of tobacco and other herbs like papaya. The ingredients in a kudzu based snuff or chew can be swallowed without harming the esophageal tissues, stomach lining or lungs. Kudzu leaves do not have a strong flavor, albeit a mild sweet flavor that does not overwhelm the flavoring components of the composition.

The present invention exists in various forms and embodiments. In one exemplary embodiment according to the present invention, moist snuff and chew are presented which include certain typical components: base herb—to provide the foundation of the compound; binder (casing component)—to create a cohesive cud; humectant—to maintain moisture content; abrasive—to provide additional organoleptic qualities to the product similar to tobacco; preservatives—to prevent spoilage; flavorings—to provide an appealing taste; PH balancer—to balance possible acidic or basic qualities of the ingredients In one exemplary embodiment, the production of snuff includes: 45 to 80 percent by weight kudzu leaves as the base herb; 20 to 50 percent by weight glycerin as the binder and humectant.; 0.00005 to 5 percent by weight flavoring as either essential oils or powder; 0.00001 to 0.0002 percent by weight salt to provide flavor enhancement and act as an abrasive.

In production of snuff according to an exemplary embodiment of the present invention, a number of steps may be followed. First, there is the harvesting of fresh mature kudzu leaves, being those with the firmest and most resilient qualities. These leaves are typically found in plenty supply during the mid to late summer months. The leaves are then stacked flat and lightly pressed into a flat container that allows for the passage of fluids through the sides and bottom such as a strainer. The strainer containing the leaves is immersed in a heated solution of water and glycerin in a ratio of 4 parts water to 1 part glycerin for between 2 and 4 hours. This step allows the glycerin to infuse into the kudzu leaves, leaving them pliable and retains moisture. During this step, the glycerin/water solution is heated to between 120 degrees Fahrenheit to 180 degrees Fahrenheit, but short of a boiling temperature. The strainer is removed, shaken and re-immersed into the solution multiple times during this step to insure an even distribution of solution across all herbal material. The leaves are then dried to a moisture content between 5 percent and 15 percent, with 7 percent being the preferred moisture content. This is best accomplished through an air heating unit at 140 degrees Fahrenheit that provides a fan for air flow (a dehydrator).

After drying, the leaves are then cut and sifted to the appropriate size, preferably 1 mm in width and between 1 mm to 5 mm in length with the stems and large veins removed. The smaller veins (those that will pass through the screens during sifting) are left in the product as they provide additional cohesive qualities to the composition. The dried and sifted leaves are then mixed in bulk with the glycerin to achieve the appropriate texture. This may be accomplished using a ribbon blender. Flavoring is then added in the form of essential oils (peppermint oil, wintergreen oil, lemon oil, orange oil, cinnamon oil, etc.) or plant material (mint leaves, ground cinnamon, lemon or orange rind, etc.) to meet the required flavoring requirements. Salt when used as a flavor enhancer is added at this point as well. The composition is then mixed once again in the ribbon blender until the composition is well covered with the flavoring. When essential oils are used as a flavoring, the composition should be stored for a period from 7 to 14 days to allow the oils to be fully absorbed in the composition.

In another exemplary embodiment, used in the production of chew, a number of steps may be taken, which includes: 45 to 80 percent by weight kudzu leaves are used as the base herb; 20 to 40 percent by weight molasses is used as the binder and a flavoring; 10 to 40 percent by weight glycerin is used as a binder and humectant; 0.00005 to 5 percent by weight flavoring is used as either essential oils or powder; 0.00001 to 0.0002 percent by weight salt is used to provide flavor enhancement and act as an abrasive.

A production process for chew or plug, in accordance with an exemplary embodiment of the present invention, includes harvesting of fresh mature kudzu leaves, being those with the firmest and most resilient qualities. These leaves are typically found in plenty during the mid to late summer months. The leaves are then stacked flat and lightly pressed into a flat container that allows for the passage of fluids through the sides and bottom such as a strainer. The strainer containing the leaves is immersed in a heated solution of water and glycerin in a ratio of 4 parts water to 1 part glycerin for between 2 and 4 hours. This step allows the glycerin to infuse into the kudzu leaves, leaving them pliable and retains moisture. During this step, the glycerin/water solution is heated to between 120 degrees Fahrenheit to 180 degrees Fahrenheit, but short of a boiling temperature. The strainer will be removed, shaken and re-immersed into the solution multiple times during this step to insure and even distribution of solution across all herbal material. The leaves are then dried to a moisture content between 5 percent and 15 percent, with 10 percent being the preferred moisture content. This is best accomplished through an air heating unit at 140 degrees Fahrenheit that provides a fan for air flow (a dehydrator).

After drying, the leaves are then cut and sifted to the appropriate size, preferably 3 mm in width and between 3 mm to 15 mm in length with the stems and large veins removed. The dried and sifted leaves are then mixed in bulk with a glycerin and molasses mixture to achieve the appropriate texture. This should be accomplished using a ribbon blender. Flavoring is then added in the form of essential oils (peppermint oil, wintergreen oil, lemon oil, orange oil, cinnamon oil, etc.) or plant material (mint leaves, ground cinnamon, lemon or orange rind, etc.) to meet the required flavoring requirements. Salt when used as a flavor enhancer is added at this point as well. The composition is then mixed once again in the ribbon blender until the composition is well covered with the flavoring. When essential oils are used as a flavoring, the composition should be stored for a period from 7 to 14 days to allow the oils to be fully absorbed in the composition. When producing a plug, the composition is pressed into the appropriate plug shape.

Various specific flavored products may be produced according to the present invention. In another exemplary embodiment, an alternative preparation of kudzu as snuff is presented. First, to ensure drying and curing, when kudzu is harvested manually (harvesting only leaves rather than bales), the kudzu should be dried slowly in a pile no deeper than 12 inches. They should be flipped (bringing top to bottom) at least every 8 hours. Kudzu from bales is quickly dried in the field and includes about 50% vines. In this manner no drying or curing is required.

Then the basic mixture is produced from bales or harvested leaves. A rough cut is made of bales of dried kudzu into smaller pieces using a shredder removing large vines. Then a fine cut dried kudzu to a powder like consistency. A sift using an 18 mesh screen (18 holes per inch) to remove all unwanted particles. This may require multiple sifting operations. Then rehydrate dried kudzu is mixed with water in a 1 to 1 weight ratio (400 g kudzu powder, 400 g water), then mixed with 700 g glycerin. Infusing the leaves with glycerin prior to drying makes it sometimes difficult for sifting out the stems, so this step may be optional.

To proceed with the coloring step, if the kudzu leaves have been cured then no coloring is required. If the kudzu leaves have come from bales then 6 tablespoons (80 g) of extra dark caramel color (color intensity of about 0.5) are used for each 1500 g of basic mixture.

To produce a mint flavor (per 1500 g of basic mixture), the following are added: 4 teaspoons of peppermint oil; 2 teaspoons of cayenne pepper; 1 teaspoon of salt.

To produce a spicy flavor (per 1500 g of basic mixture), the following are added: 2 teaspoons of cayenne pepper; 3 heaping tablespoons of Tabasco mash (provided by McIlhenny Co., consisting of Tabasco peppers, salt and vinegar); 3 tablespoons of Tabasco sauce (McIlhenny Co.).

In another exemplary embodiment according to the present invention, a process is presented for small production runs of about forty 1.2 ounce tins. The general steps of this process include: 1) harvest kudzu leaves; 2) "house dry" the leaves (slow dry over 7 to 14 days in a moisture controlled room), turning the pile of leaves every 8 to 12 hours; 3) cut the leaves into fine particles using a high speed cutting device, which could either be multiple home food processors, or a larger high speed cutting device; 4) sift the leaves to remove stems, sticks, leaf veins, vines and large particles using a #18 mesh (18 holes per linear inch), which could be done using a Russell Finex 24 inch vibratory screener such that all vertical movement is removed to reduce the amount of sticks that will feed through; 5) once sifted, the leaves are rehydrated by adding water (50/50) ratio by weight. (400 g Kudzu leaves, 400 g Water); 6) the rehydrated leaves are then mixed with glycerin (800 g re-hydrated kudzu leaves and 700 g Glycerin (P&G Chemicals Superol V 99.7% vegetable glycerin), which may be done with a hand mixer on slow speeds, but when the resulting mixture clumps, additional mixing with a high speed mixer is required; 7) flavoring is added which is suited to taste, and can include, for example, a) Mint Flavor: 4 teaspoons peppermint oil (6 grams), 1 teaspoon salt (1 gram), 2 teaspoons cayenne pepper powder (2 grams); b) Spitfire (Tabasco Flavor): 3 Tablespoons tabasco mash (provided from McIlhenny as remnants from their tabasco sauce process, 12 grams) and 2 teaspoons cayenne pepper powder (2 grams); 8) the mixture is then put into a high speed mixer (food processor) to remove the clumps and homogenize the flavoring.

Actual recipes in weight are, for the Mint Flavor: 800 grams (53%) rehydrated kudzu leaves (400 grams dried leaves and 400 grams water), 700 grams (46.4%) glycerin, 6 grams (0.4%) peppermint oil, 1 gram (0.06%) salt, 2 grams (0.14%) cayenne pepper. For the Spitfire Flavor: 800 grams (52.8%) rehydrated kudzu leaves (400 grams dried leaves and 400 grams water), 700 grams (46.2%) glycerin, 12 grams (0.8%) tabasco mash, 2 grams (0.14%) cayenne pepper.

Although various ingredients have been described above as part of a composition according to the present invention, these ingredients are merely exemplary and not limiting of that which may be used within the present invention. For example, alternative embodiment ingredients could include: additional herbal components which could be used in a lesser quantity than kudzu to provide the basis of the primary non-herbal component; the use of an alternative binder, such as sorbitol, maltitol, molasses, corn syrup, or honey; the use of alternative abrasives, such as baking soda, lemon or orange peels or other products that may be added for organoleptic qualities including but not limited to red clover, corn silk, mint leaves, grape leaves, dandelion, alfalfa, chicorium, papaya, doc, sorrel, sunflower, *calendula, nasturtium*, mallow, chicory, tea leaves, salt, sodium bicarbonate; the use of plant material to provide flavoring, such as mint leaves, flower blossoms or dried powders; immature or aged kudzu leaves in addition to or instead of mature leaves; the use of supplemental ingredients to provide additional benefits beyond flavoring, abrasion and preservatives, such as caffeine, nicotine, vitamins, minerals and herbal supplements; the use of supplemental ingredients such as cayenne pepper to provide a tobacco-like burn; the use of alternative flavor enhancers such as monosodium glutamate (MSG); the addition of preservatives and/or PH balancers.

Many items may be added as non-essential ingredients. Any vitamin, herb or chemical can be added to provide additional benefits. Some exemplary ones include anti-oxidants such as vitamin C (ascorbic acid), A and D. Also caffeine or derivatives such as guarana, coffee and tea may be added. Nicotine can also be added in pure form or as *lobelia* (herb form of Indian tobacco) which contain lobeline which has similar characteristics as nicotine. Other stimulants can also be added such as ginsing, guto kola or *ginko biloba*. When the herbal component consists essentially of kudzu, the herbal component may comprise additional non-essential ingredients to enhance certain organoleptic qualities and/or provide certain physiological effects. The additional non-essential ingredients may be classified as antiseptics, demulcents, diuretics, emollients, stimulants, tonics, rubefacients, sialagogues, hemostatics, vulneraries, or combinations thereof. For example, the non-essential ingredients of the herbal component may comprise: red clover, *Echinacea*, ginger, rose hips, white clover, sweet clover, licorice, ginseng, guaran, anise, clove, as well as any other suitable leaf, root, or gum (e.g., gum tragacanth, gum arabic, gum acacia, and/or gum karaya), and any combination thereof. Since every herb contains biochemical constituents that can have an effect on the body, the potential additional non-essential ingredients for the herbal component are limited only by the desired overall organoleptic qualities and physiological effects of the non-tobacco moist snuff composition.

Flavoring can be accomplished through the following non-limiting additions: essential oils, natural and artificial flavors, sweeteners (sugar, molasses, caramel color, sucralose or other artificial sweeteners), mint leaves (peppermint, spearmint, wintergreen), lemon peel, cinnamon, anise, licorice, ginger, cloves, coffee, tea leaves, cayenne, tabasco or other peppers, salt.

Alternative processes may also be used to produce compositions according to the present invention. For example, alternative process embodiments could include: the kudzu leaves can be simply dried rather than being infused with glycerin; the kudzu leaves could be cured in a manner similar to tobacco; the glycerin/water solution can vary from between 12 parts water to 1 part glycerin to 2 parts water to 1 part glycerin; the glycerin/water solution can utilize a lower temperature above 70 degrees Fahrenheit up to boiling temperature; the glycerin/water solution can also be infused through a steaming process rather than immersion; the strainer does not need to be repeatedly immersed and can remain in the solution for the entire period; the immersion process can be accomplished for a shorter period than 2 hours or a longer period than 4 hours; alternative drying methods could be utilized such as air drying or direct heating at higher temperatures; the leaves can be cut into appropriate sized particles and/or sifted during any stage of the process; the removal of stems and large veins can be accomplished during any stage of the process, likewise the smaller veins can be removed rather than remaining in the final composition; alternative sized particles could be used based on the desired organoleptic qualities; alternative mixing methods other than a ribbon blender could be used; flavoring, preservatives, PH balancers and additional ingredients can be added at any stage in the process including multiple times such as pre-binding and as a top dressing; when storing the composition to allow for full absorption of the essential oils, any period of time could be used including no storage time.

The foregoing disclosure of the preferred embodiments of the present invention has been presented for purposes of illustration and description. It is not intended to be exhaustive or to limit the invention to the precise forms disclosed. Many variations and modifications of the embodiments described herein will be apparent to one of ordinary skill in the art in light of the above disclosure. The scope of the invention is to be defined only by the claims appended hereto, and by their equivalents.

Further, in describing representative embodiments of the present invention, the specification may have presented the method and/or process of the present invention as a particular sequence of steps. However, to the extent that the method or process does not rely on the particular order of steps set forth herein, the method or process should not be limited to the particular sequence of steps described. As one of ordinary skill in the art would appreciate, other sequences of steps may be possible. Therefore, the particular order of the steps set forth in the specification should not be construed as limitations on the claims. In addition, the claims directed to the method and/or process of the present invention should not be limited to the performance of their steps in the order written, and one skilled in the art can readily appreciate that the sequences may be varied and still remain within the spirit and scope of the present invention.

What is claimed is:

1. A composition for use as a tobacco substitute, the composition comprising:

a 45-80% by weight herbal component including *pueraria*;

a 20-50% by weight binder to create cohesion; and a humectant to maintain moisture content.

2. The composition of claim 1, wherein the *pueraria* comprises kudzu.

3. The composition of claim 1, further comprising natural tobacco.

4. The composition of claim 1, further comprising an abrasive to provide organoleptic qualities.

5. The composition of claim 1, further comprising a preservative to prevent spoilage.

6. The composition of claim 1, further comprising flavoring.

7. The composition of claim 1, further comprising a PH balancer to balance possible acidic or basic qualities.

8. A composition for use as a tobacco substitute, the composition comprising:

45 to 80 percent by weight *pueraria* leaves as a base herb;

20 to 50 percent by weight glycerin as a binder and humectant;

0.00005 to 5 percent by weight flavoring as either essential oils or powder; and 0.00001 to 0.0002 percent by weight salt to provide flavor enhancement and act as an abrasive.

9. The composition of claim 8, further comprising natural tobacco.

10. The composition of claim 8, wherein the flavoring includes a mint flavor.

11. The composition of claim 10, wherein the mint flavor is per 1500g of basic mixture and includes: 4 teaspoons of peppermint oil; 2 teaspoons of cayenne pepper; 1 teaspoon of salt.

12. The composition of claim 8, wherein the flavoring includes a spicy flavor.

13. The composition of claim 12, wherein the spicy flavor per 1500 g of basic mixture, includes: 2 teaspoons of cayenne pepper; 3 heaping tablespoons of Tabasco mash; 3 tablespoons of Tabasco sauce.

* * * * *